US005788361A

United States Patent [19]

Lee

[11] Patent Number: 5,788,361

[45] Date of Patent: Aug. 4, 1998

[54] LIGHTING DISPLAY ASSEMBLY

[76] Inventor: Kuo-Hsing Karl Lee, 9945-B Harwin Dr., Houston, Tex. 77036

[21] Appl. No.: 735,668

[22] Filed: Oct. 17, 1996

[51] Int. Cl.[6] ..... F21V 21/00

[52] U.S. Cl. ..... 362/249; 362/252; 362/806

[58] Field of Search ..... 362/153.1, 219, 362/226, 249, 250, 252, 396, 431, 806

[56] References Cited

U.S. PATENT DOCUMENTS

| | | | |
|---|---|---|---|
| 1,702,028 | 2/1929 | Blanchard | 362/249 |
| 5,057,981 | 10/1991 | Bowen et al. | 362/806 |
| 5,597,229 | 1/1997 | Plichta et al. | 362/431 |

*Primary Examiner*—Y My Quach

[57] ABSTRACT

A lighting display assembly includes a plurality of arc assemblies and a plurality of stakes, in which each arc assembly comprises a pair of base holding arms, a first connection holding arm and a second connection holding arm connected together to form an arc shape frame. Each arc assembly further provides a plurality of holders intervally and perpendicularly thereon for holding a plurality of lampholders of a decorative lighting device in position respectively. The stakes which are connected with the pair of base holding arms of the arc assemblies respectively are adapted for planting on ground for continuously supporting all the arc assemblies in upright position on the ground.

14 Claims, 5 Drawing Sheets

LIGHTING DISPLAY ASSEMBLY

BACKGROUND OF THE INVENTION

The present invention relates to a lighting display assembly, and more particularly to an arc shaped lighting display assembly for holding lampholders and providing a more enhancing holiday displays.

All sorts of holidays are being celebrated every year, and every custom has its own way of celebrating a special day or moment. Christmas holiday is one of the most well known and celebrated holidays today, as we all know that Christmas is one of the most important holidays for many of us. It's a time when the families get together to give and share love, and to create a memorable moment for everyone. When Christmas time comes, besides all the presents a common household would first of all purchase a Christmas tree and a set of Christmas displaying lights to enhance the holiday spirit.

A Christmas holiday without any Christmas lights would just be very unusual and dead. When we view Christmas from another perspective, we will clearly notice the importance of Christmas displaying lights. As we all know that the more Christmas displaying lights we have around the house during the holiday would bring a more pleasant and memorable moment into our spirit during the special holidays. Most people today only decorate their Christmas trees, and some when along decorating the house and some small trees in their yard.

Recently, some people bend a metal wire to a continuous wave form supporting frame affixed on the front or back lawn for tightening a series of lighting bulbs connected intervally with electric wires for decorating our lawn. It is a great idea, especially the structural design of the product providing a series of arches lighting for our front lawn, the idea greatly enhances the holiday displays, but sometimes providing an idea just isn't enough.

Firstly, it is very difficult to ensure that all the wave arcs are identical shaped and spaced. The continuous wave form supporting frame is too big and long that it takes a lot of space during storage. Moreover, physics proof that such hand made structure is less durable and rigid. The mounting operation of the numerous lighting bulbs is real troublesome and it is very difficult to affix each lighting bulb to the metal wire to equally spaced and to maintain in upright position. Also, such configuration takes a great hassle during bulb replacement.

SUMMARY OF THE PRESENT INVENTION

The main object of the present invention is to provide a lighting display assembly which enables a continuous decorating lighting chain to be easily, uniformly and intervally mounted thereon in continuous arc-shape for enhancing holiday displays which can provide a more pleasant and memorable moment during holiday time.

Another object of the present invention is to provide a lighting display assembly displays which having external holding means for an easy access during bulb replacement.

Another object of the present invention is to provide a lighting display assembly which has rigid structure and can be disassembled for easy and convenient storage.

Accordingly, the present invention provides a lighting display assembly which comprises a plurality of arc assemblies and a plurality of skates. Each arc assembly comprises a pair of base holding arms, a first connection holding arm and a second connection holding arm. The arc assembly further has a plurality of holders provided intervally and perpendicularly on the two base holding arms and the first and second connection holding arms respectively.

Each base holding arm is in arc shape and has a front side, a first connecting end connected with a plug and a second connecting end connected with a first connector. The first connector is a rectangular plug having a width and a thickness smaller than that of the base holding arm. Each first connection holding arm and each the second connection holding arm are in arc shape of equal curvature. Each first connection holding arm has a front side, a first end and a second end, in which the first end of the first connection holding arm has a first receiver which is a rectangular socket adapted for tightly and firmly receiving the first connector of one of the base holding arm therein. The second end of the first connection holding arm has a second connector which is a rectangular plug.

Each second connection holding arm has a front side, a first end and a second end, in which the first end of the second connection holding arm has a second receiver which is a rectangular socket adapted for firmly and tightly receiving the second connector of the first connection holding arm. The second end of the second connection holding arm has a third receiver which is a rectangular socket adapted for firmly and tightly receiving the first connector of another the base holding arm.

The plurality of holders are spacedly provided along the two base holding arm, the first connection holding arm and the second connection holding arm respectively, wherein each of the holders has an arc groove transversely indented on the front sides of the two base holding arm and the first and second connection holding arm respectively. Each the holder further has two holding arms protruding upwardly and inwardly from two edges of the arc groove of the holder so as to define a receiving clip chamber.

Each stake comprises a body plate, at least two receiving towers parallelly affixed on a top surface of the body plate, and a supporting stem downwardly extended from a bottom surface of the body plate. Each receiving tower is a hollow cylindrical engaging tube protruded vertically from the top surface of the body plate. A plurality of reinforcing ribs are extended from an outer circumference of each the receiving tower to the top surface of the body plate in order to rigidly hold the receiving tower in an upright position. An inner wall of each receiving tower protrudes a plurality of vertical receiving guides, in which the plug of the base holding arm is tightly inserted into the respective receiving tower for firmly supporting the arc assembly in an upright position. Moreover, when the plug is inserted into the receiving tower, the receiving guides press against an exterior surface of the plug to engage the plug firmly and tightly in position.

The supporting stem of each the stake has a cross section of cross shape so as to define four supporting ribs and four pits extending along and between the four supporting ribs respectively, wherein the supporting stem which further has a sharpened end tail is adapted for ground planting.

DETAILED DESCRIPTION OF THE PREFERRED EMBODIMENT

Figure 1:
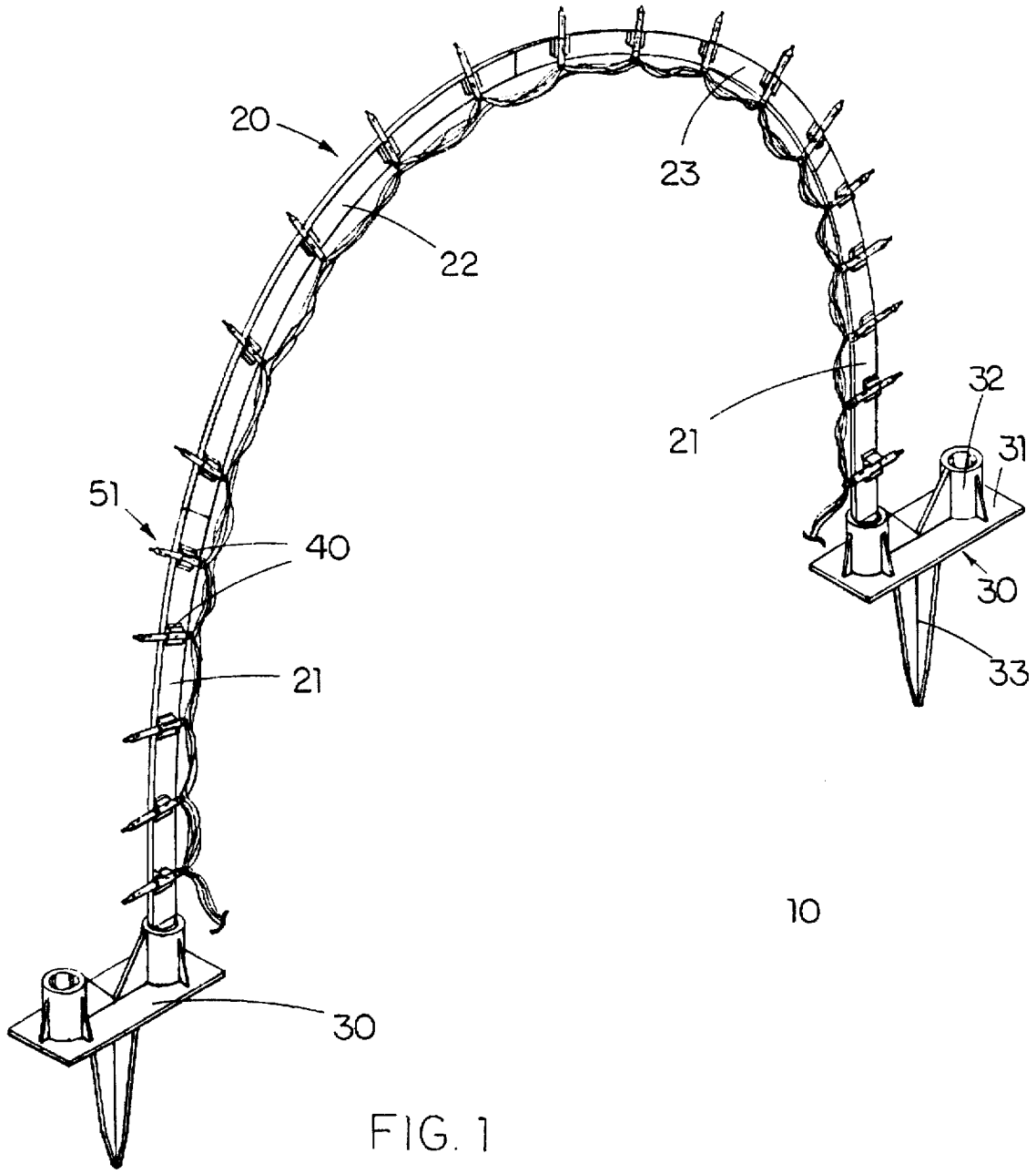
FIG. 1 is a perspective view of an arc assembly incorporated with two stakes of a lighting display assembly of a preferred embodiment according to the present invention.
Figure 3:
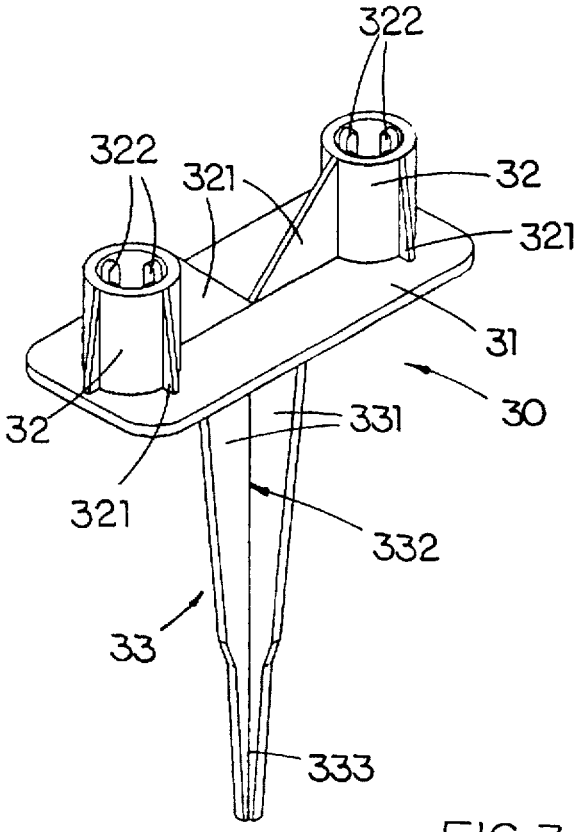
FIG. 3 is a perspective view of a stake of the lighting display assembly of the above preferred embodiment according to the present invention.
Figure 4:
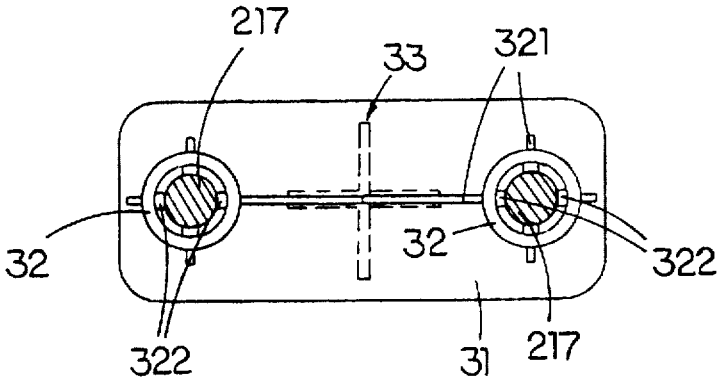
FIG. 4 is a top view of the stake of the lighting display assembly of the above preferred embodiment according to the present invention.
Figure 5:
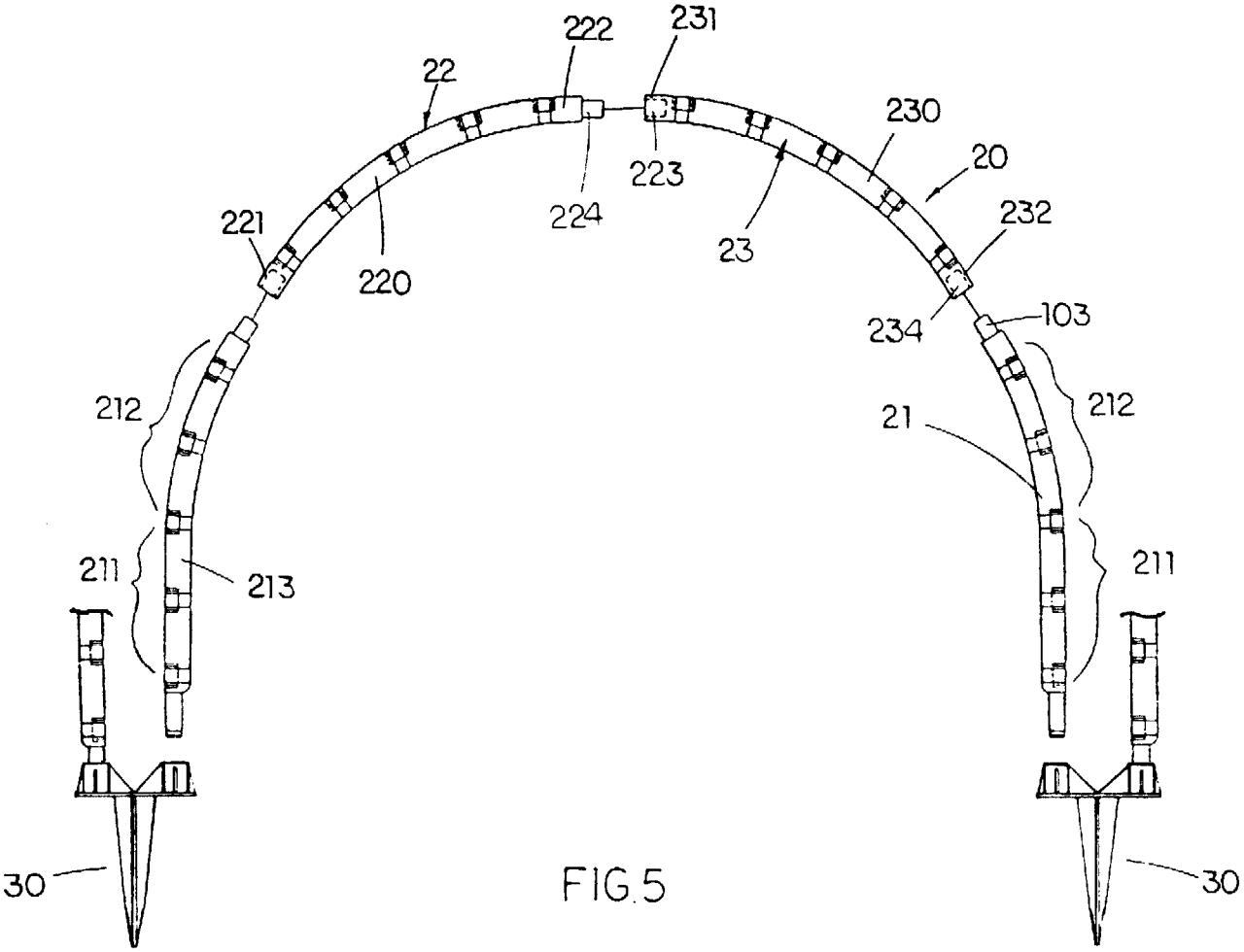
FIG. 5 is a front view of a disassembled arc assembly of the lighting display assembly of the above preferred embodiment according to the present invention.
Figure 6:
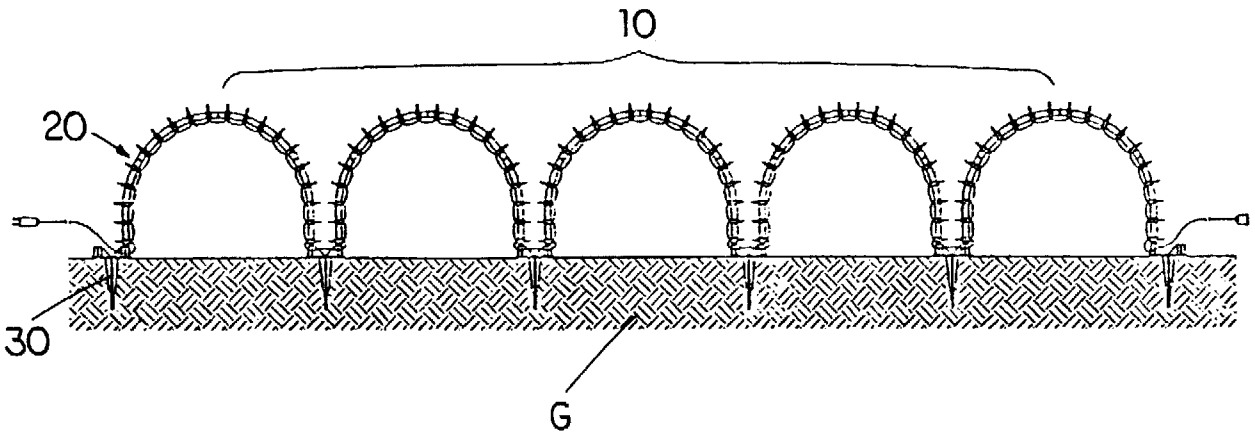
FIG. 6 is an overall front view of a lighting display assembly of the above preferred embodiment according to the present invention, showing the lighting display assembly in structural standing position.

Please referring to FIGS. 1 to 6, a lighting display assembly 10, as shown in FIG. 6, of a preferred embodiment of the present invention is illustrated. The lighting display assembly 10 for enhancing holiday displays comprises a plurality of arc assemblies 20 and a plurality of stakes 30. Each arc assembly 20, as shown in FIGS. 1 and 5, comprises a pair of base holding arms 21, a first connection holding arm 22 and a second connection holding arm 23. The arc assembly further has a plurality of holders 40 provided intervally and perpendicularly on the two base holding arms 21 and the first and second connection holding arms 22, 23 respectively in an evenly spread manner.

Figure 2:
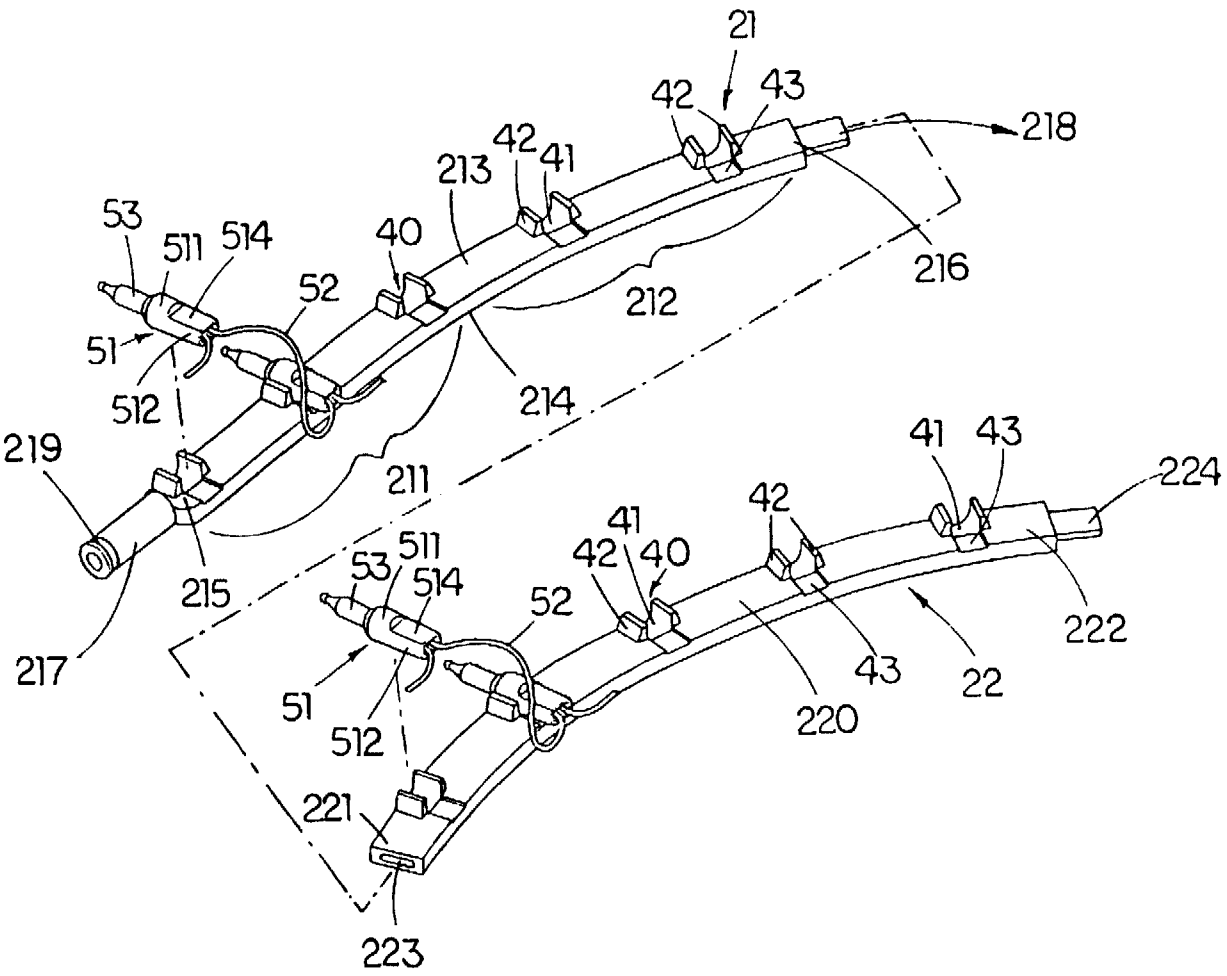
FIG. 2 is a perspective view of the lighting display assembly of the above preferred embodiment according to the present invention, showing the connection between the arc portion and the engagement between the arc portion and the lampholders.

Please referring to FIGS. 2 and 5, the base holding arm 21 has a straight portion 211 and an arc portion 212. The base holding arm 21 is made of a durable solid rigid plastic strip having a front side 213 and a back side 214, in which the width of the base holding arm 21 is uniform according to the preferred embodiment. The straight portion 211 of the base holding arm 21 has a first connecting end 215 and the arc portion 212 of the base holding arm 21 has a second connecting end 216. The base holding arm 21 further comprises a cylindrical plug 217 and a connector 218 affixed to the first connecting end 215 and the second connecting end 216 thereof respectively. The cylindrical plug 217 is a cylindrical engaging protrusion and has a circular groove 219 provided at an end portion of the plug 217. In accordance with the present embodiment, the connector 218 is a rectangular plug having a width and a thickness smaller than that of the base holding arm 21.

The first and second connection holding arms 22, 23 are both in arc shape of equal curvature and each has a front side 220, 230. The first connection holding arm 22 has a first end 221 and a second end 222, in which a receiver 223 is provided at the first end 221 for engaging with the connector 218 of one of the base holding arm 21, as shown in FIG. 2, while a second connector 224 is provided at the second end 222. In accordance with the present embodiment as shown in FIG. 2, the receiver 223 is a rectangular socket formed on the first end 221. The socket receiver 223 has a width, a depth and a thickness equal to or slightly smaller than the width, the length and the thickness of the connector 218, so that the connector 218 is able to firmly insert into the receiver 223 to ensure a rigid connection between the first base holding arm 21 and the first connection holding arm 22.

The second connection holding arm 23 also has a first end 231 and a second end 232, in which two receivers 233, 234 are provided at the first end 231 and the second end 232 respectively as shown in FIG. 5. In accordance with present embodiment, the two receivers 233, 234 both are a rectangular socket and have a similar size as the receiver 223 of the first connection holding arm 22 for receiving the connectors 224, 103 of the first connection holding arm 22 and another base holding arm 21 respectively. Therefore, the two base holding arms 21 and the first and second connection holding arms 22, 23 are able to connect together to form an elongated rigid arc shape, as shown in FIGS. 5 and 6, by firmly inserting the connectors 218, 224 to the receivers 223, 233 and 234 respectively.

The most popular decorative lighting device in the market nowadays comprises a plurality of lampholders 51 which are connected with electric wires 52 for electrically connecting and holding a plurality of lighting bulbs 53, as shown in FIG. 2. Each lampholder 51 has an upper round body 511 and a tail portion 512 which has two opposing flat surfaces 514 formed on both sides thereof respectively. In order to enabling the lampholders 51 being easily and firmly mounted on the arc assembly 20 of the present embodiment, along an outer periphery of the two base holding arm 21, the first connection holding arm 22 and the second connection holding arm 23, the plurality of holders 40 are formed thereon. Each of the holders 40 has an arc groove 41 transversely indented on the front sides 213, 220, 230 of the two base holding arm 21 and the first and second connection holding arm 22, 23 respectively. Each holder 40 further has two holding arms 42 protruding upwardly and inwardly from two edges of the arc groove 41 thereof, so as to define a receiving clip chamber having a diameter slightly smaller than the largest diameter of the body 511 of the lampholder 51. In accordance with the present embodiment, the holders 40 are evenly spaced and spread along the two base holding arms 21 and the first and second connection holding arms 22, 23, as shown in FIGS. 2 and 5, so that the lampholders 51 are able to be inserted and firmly clipped within the receiving clip chambers of the holders 40 intervally and respectively. By providing the two holding arms 42 of the receiving clip chambers to firmly hold the body 511 of the lampholder 51 in position by clipping against the circumference of the body 511 , the thickness of the two base holding arms 21 and the first and second connection holding arms 22, 23 can be minimized for reducing the manufacturing cost and packaging size thereof.

In order to avoid any unexpected movement of the positioned lampholder 51, between the arc groove 41 and an inner periphery edge of each base holding arm 21 or the first or second connection holding arm 22, 23, a rectangular positioning groove 43 is provided. Therefore each tail portion 512 of the lampholder 51 can be sat on the positioning groove 43 to prevent the lampholder 51 from rocking.

As shown in FIGS. 3 and 4, a stake 30 for standing support of the arc assembly 20 is illustrated. The stake 30 comprises a body plate 31, two receiving towers 32 parallelly affixed on a top surface of the body plate 31, and a supporting stem 33 downwardly extended from a bottom surface of the body plate 31 for inserting into the soil or grass ground (as shown in FIG. 6).

Each receiving tower 32 is a hollow cylindrical engaging tube protruded vertically from the top surface of the body plate 31. The distance between the two receiving towers 32 must be larger than the total length of two lamp bulbs 53. A plurality of reinforcing ribs 321 are extended from an outer circumference of each receiving tower 32 to the top surface of the body plate 31 in order to rigidly hold the receiving tower 32 in an upright position.

An inner wall of each receiving tower 32 protrudes a plurality of vertical receiving guides 322. By inserting the two plugs 217 of the base holding arm 21 into the receiving towers 32 of two stakes 30, the arc assembly 20 can thus be firmly supported in an upright position (as shown in FIG. 6). Whereby, when the plug 217 is inserted into the receiving tower 32, the receiving guides 322 press against the exterior surface of the plug 217 to engage the plug 217 firmly and tightly in position. The supporting stem 33 of each stake 30 has a cross section of cross shape so as to define four supporting ribs 331 and four pits 332 extending along and between the supporting ribs 331 respectively. The supporting stem 33 has a sharpened end tail 333 for facilitating the insertion of the supporting stem 33 into the soil or grass ground. During the inserting of the supporting stem 33, the cross shape of the supporting stem 33 minimizes the planar contact area and thus minimizes the resisting friction between the soil and the supporting stem 33. Moreover, the four pits 232 of supporting stem 33 enables the excess soil to push out. After the supporting stem 33 is inserted into the ground in position, the soil filled in the four pits 332 relatively support the stake 30 to firmly maintain in upright position.

As shown in FIG. 6, each arc assembly 20 is integrally assembled by jointing the two base holding arms 21 and the first and second connection holding arms 22, 23. The two receiving towers 32 of each stake 30 is engaged with two plugs 217 of two arc assemblies 20 respectively. The plurality of arc assemblies 20 can thus be assembled together to form the continuous lighting display assembly 10. After mounting the lampholders 51 of the decorative lighting device onto the holders 40 of the arc assemblies 20 respectively, the lighting display assembly 10 can then be affixed on the soil or grass ground G by planting the supporting stems 33 of the stakes 30 into the ground G. For storage, packaging or transportation, the lighting display assembly 10 can be disassembled to reduce its overall size.

I claim:

1. A lighting display assembly, comprising a plurality of arc assemblies, each of said arc assemblies comprising a pair of base holding arms, a first connection holding arm and a second connection holding arm, said arc assembly further having a plurality of holders spaced intervally along and perpendicularly provided on said two base holding arms and said first and second connection holding arms respectively; wherein each of said base holding arms having an arc shape and has a front side, a first connecting end connected with a plug and a second connecting end connected with a first connector, said first connector being a rectangular plug having a width and a thickness smaller a width and a thickness of said base holding arm;

said first connection holding arm and said second connection holding arm being in arc shape of equal curvature, said first connection holding arm having a front side, a first end and a second end, said first end of said first connection holding arm having a first receiver which is a rectangular socket adapted for tightly and firmly receiving said first connector of one of said base holding arms therein, said second end of said first connection holding arm having a second connector which is a rectangular plug;

said second connection holding arm having a front side, a first end and a second end, said first end of said second connection holding arm having a second receiver which is a rectangular socket adapted for firmly and tightly receiving said second connector of said first connection holding arm, said second end of said second connection holding arm having a third receiver which is a rectangular socket adapted for firmly and tightly receiving said first connector of another of said base holding arms;

wherein each of said holders has an arc groove, said arc grooves transversely indented on said front sides of said two base holding arms and said first and second connection holding arms, each of said holders further has two holding arms protruding upwardly and inwardly from two edges of said arc groove of said holder so as to define a receiving clip chamber; and a plurality of stakes wherein each of said stakes comprises a body plate, at least two receiving towers parallelly affixed on a top surface of said body plate, and a supporting stem downwardly extended from a bottom surface of said body plate;

each of said receiving towers comprising a hollow cylindrical engaging tube protruded vertically from said top surface of said body plate, a plurality of reinforcing ribs being extended from an outer circumference of each of said receiving towers to said top surface of said body plate in order to rigidly hold said receiving tower in an upright position, an inner wall of each of said receiving towers protruding a plurality of vertical receiving guides, in which said plug of said base holding arm tightly inserting into said respective receiving tower for firmly supporting said arc assembly in an upright position, and said receiving guides pressing against an exterior surface of said plug to engage said plug firmly and tightly in position; and said supporting stem of each of said stake having a cross section of cross shape so as to define four supporting ribs and four pits extending along and between said four supporting ribs respectively, and said supporting stem which further has a sharpened end tail is adapted for ground planting.

2. A lighting display assembly, as recited in claim 1, wherein each said base holding arm has a straight portion near said first connecting end and an arc portion near said second connecting end.

3. A lighting display assembly, as recited in claim 1, wherein said plug is a cylindrical engaging protrusion and has circular groove provided at an end portion of said plug.

4. A lighting display assembly, as recited in claim 1, further comprising a decorative lighting device which comprises a plurality of lampholders which are connected with electric wires for electrically connecting and holding a plurality of lighting lamp bulbs, each of said lampholder having an upper round body and a tail portion which has two opposing flat surfaces formed on both sides thereof respectively, said arc groove of each of said holders having a diameter slightly smaller than a largest diameter of said body of each of said lampholders, so that said lampholders are able to be inserted and firmly clipped within said receiving clip chambers of said holders, said two holding arms of each of said holders firmly hold said body of said lampholder in position by clipping against a circumference surface of said body.

5. A lighting display assembly, as recited in claim 4, wherein a distance between said two receiving towers is larger than a total length of two lamp bulbs.

6. A lighting display assembly, as recited in claim 4, wherein a plurality of rectangular positioning grooves are provided between said arc grooves and an inner periphery edge of said base holding arms and said first and second connection holding arms each of said tail portions sitting on said positioning groove to prevent said lampholder from rocking.

7. A lighting display assembly, as recited in claim 1, wherein a plurality of rectangular positioning grooves are provided between said arc grooves and an inner periphery edge of said base holding arm, and said first and second connection holding arms.

8. A lighting display assembly, comprising a plurality of arc assemblies, each of said arc assemblies comprising a pair of base holding arms, a first connection holding arm and a second connection holding arm, said arc assembly further having a plurality of holders spaced intervally along and perpendicularly provided on said two base holding arms and said first and second connection holding arms respectively; wherein each of said base holding arm having an arc shape and has a front side, a first connecting end connected with a plug and a second connecting end;

said first connection holding arm and said second connection holding arm being in arc shape of equal curvature, said first connection holding arm having a front side, a first end connected with said second connecting end of one of said base holding arm, and a second end;

said second connection holding arm having a front side, a first end connected with said second end of said first connection holding arm, and a second end connected with said second connecting end of another of said base holding arms;

wherein each of said holders has an arc groove, said arc grooves transversely indented on said front sides of said two base holding arms and said first and second connection holding arms each of said holders further has two holding arms protruding upwardly and inwardly from two edges of said arc groove of said holder so as to define a receiving clip chamber; and a plurality of stakes wherein each of said stake comprises a body plate, at least two receiving towers parallelly affixed on a top surface of said body plate, and a supporting stem downwardly extended from a bottom surface of said body plate;

each of said receiving towers comprising a hollow cylindrical engaging tube protruded vertically from said top surface of said body plate, a plurality of reinforcing ribs being extended from an outer circumference of each of said receiving tower to said top surface of said body plate in order to rigidly hold said receiving tower in an upright position, an inner wall of each of said receiving towers protruding a plurality of vertical receiving guides, said plug of said base holding arm tightly inserting into said respective receiving tower for firmly supporting said arc assembly in an upright position, and said receiving guides pressing against an exterior surface of said plug to engage said plug firmly and tightly in position; and said supporting stem of each of said stake having a cross section of cross shape so as to define four supporting ribs and four pits extending along and between said four supporting ribs respectively, and said supporting stem which further has a sharpened end tail is adapted for ground planting.

9. A lighting display assembly, as recited in claim 8, wherein each said base holding arm has a straight portion near said first connecting end and an arc portion near said second connecting end.

10. A lighting display assembly, as recited in claim 8, wherein said plug is a cylindrical engaging protrusion and has circular groove provided at an end portion of said plug.

11. A lighting display assembly, as recited in claim 8, further comprising a decorative lighting device which comprises a plurality of lampholders which are connected with electric wires for electrically connecting and holding a plurality of lighting lamp bulbs, each of said lampholders having an upper round body and a tail portion which has two opposing flat surfaces formed on both sides thereof respectively, said arc groove of each of said holder having a diameter slightly smaller than a largest diameter of said body of each said lampholder, so that said lampholders are able to be inserted and firmly clipped within said receiving clip chambers of said holders, said two holding arms of each of said holders firmly hold said body of said lampholder in position by clipping against a circumference surface of said body.

12. A lighting display assembly, as recited in claim 11, wherein a distance between said two receiving towers is larger than a total length of two lamp bulbs.

13. A lighting display assembly, as recited in claim 11, wherein a plurality of rectangular positioning grooves are provided between said arc grooves and an inner periphery edge of each of said base holding arm and said first and second connection holding arms each of said tail portions sitting on said positioning groove to prevent said lampholder from rocking.

14. A lighting display assembly, as recited in claim 8, wherein a plurality of rectangular positioning grooves are provided between said arc grooves and an inner periphery edge of each of said base holding arms and said first and second connection holding arm.

* * * * *